US005126515A

United States Patent [19]

Sugimoto

[11] Patent Number: 5,126,515

[45] Date of Patent: Jun. 30, 1992

[54] ACCELERATION DETECTING SYSTEM

[75] Inventor: Tomiji Sugimoto, Saitama, Japan

[73] Assignee: Honda Giken Kogyo Kabushiki Kaisha, Tokyo, Japan

[21] Appl. No.: 627,454

[22] Filed: Dec. 14, 1990

[30] Foreign Application Priority Data

Dec. 15, 1989 [JP] Japan ..... 1-325180

[51] Int. Cl.[5] ..... H01H 35/14

[52] U.S. Cl. ..... 200/61.45 R; 200/61.53

[58] Field of Search ..... 200/61.45 R-61.53

[56] References Cited

U.S. PATENT DOCUMENTS

| | | | |
|---|---|---|---|
| 4,097,699 | 6/1978 | Larson | 200/61.45 R |
| 4,188,517 | 2/1980 | Narita et al. | 200/61.45 R |
| 4,221,940 | 9/1980 | Roth | 200/61.45 R |
| 4,249,046 | 2/1981 | Livers et al. | 200/61.45 R |
| 4,536,629 | 8/1985 | Diller | 200/61.45 R |
| 4,885,439 | 12/1989 | Otsubo | 200/61.45 R |
| 4,929,805 | 5/1990 | Otsubo | 200/61.45 R |
| 5,017,743 | 5/1991 | Gunning et al. | 200/61.53 X |

FOREIGN PATENT DOCUMENTS 64-40142 3/1989 Japan .

*Primary Examiner*—J. R. Scott

*Attorney, Agent, or Firm*—Armstrong & Kubovcik

[57] ABSTRACT

An acceleration detecting system includes a base plate made of non-conductive material and mounted on a moving object. A stationary contact is fixedly disposed on the base plate and is formed of a first plate-like contact portion fixed and electrically connected at a base end thereof to the first connecting terminal, and a second plate-like contact portion fixed and electrically connected at a base end thereof to the second connecting terminal through a resistor element. A movable contact, which cooperates with the stationary contact to constitute an acceleration detecting switch, is electrically connected to the second connecting terminal and floatingly supported on the base plate so that the movable contact can abut against an intermediate portion or free end of the stationary contact. It is possible to reliably detect a failure of conduction between the first and second connecting terminals by monitoring the energization of an energizing circuit including an acceleration switch and particularly, at a coupled portion or junction of the stationary contact.

5 Claims, 5 Drawing Sheets

ACCELERATION DETECTING SYSTEM

BACKGROUND OF THE INVENTION

1. Field of the Invention

The field of the present invention is acceleration detecting systems of a type having a base plate made of non-conductive material and mounted on a moving object, a stationary contact fixedly disposed on the base plate and electrically connected to a first connecting terminal, and a movable contact cooperating with the stationary contact to constitute an acceleration detecting switch, the movable contact being floatingly supported on the base plate in an opposed relation to the stationary contact and electrically connected to a second connecting terminal, the stationary contact being electrically connected to the second connecting terminal through a resistor element.

2. Description of the Prior Art

Such a system is conventionally known from Japanese Utility Model Application Laid-open No. 40142/89.

In the above prior art system, the movable contact is disposed in an opposed relation to a plate-like stationary contact to constitute the acceleration detecting switch, and the stationary and movable contacts are interconnected through the resistor element which is in parallel to the switch in order to detect a failure of conduction in an energizing circuit including the switch. With such a construction, a weak current can be permitted to flow through the resistor element by energization of the energizing circuit when the switch is opened, and by detection of the weak current, it can be detected whether or not there is a failure of conduction in the energizing circuit. On the energizing circuit a failure of conduction can occur at a coupled portion or junction of the stationary contact. In the above prior art system, a weak current can be permitted to flow through the resistor element even if a failure at the coupled portion of the stationary contact occurs. However, it is impossible to detect the occurrence of the failure of conduction at the coupled portion of the stationary contact.

SUMMARY OF THE INVENTION

Therefore, it is an object of the present invention to provide an acceleration detecting system wherein a failure of conduction at the coupled portion of the stationary contact can be detected.

According to the present invention, the stationary contact is comprised of a first plate-like contact portion fixed and electrically connected at a base end thereof to the first connecting terminal, and a second plate-like contact portion fixed and electrically connected at a base end thereof to the second connecting terminal through the resistor element, free ends of the plate-like contact portions being interconnected.

With the above construction, when acceleration acts on a moving object, the movable contact is operated by inertia to abut against the stationary contact, thereby bringing the acceleration detecting switch into a closed state. When the acceleration detecting switch is opened, there is formed a serial circuit which extends from the first connecting terminal through the first and second plate-like contact portions of the stationary contact and the resistor element to the second connecting terminal. By monitoring energization of the serial circuit, it is possible to detect any failure in energization of the energizing circuit including the acceleration detecting switch and moreover, it is possible to reliably detect a failure of conduction at electric junctions of the stationary contact to the first and second connecting terminals. Further, even if a portion of the stationary contact is broken, it is possible to detect a failure or breakage such as a failure of conduction.

The above and other objects, features and advantages of the invention will become apparent from reading of the following description of the preferred embodiments, taken in conjunction with the accompanying drawings.

BRIEF DESCRIPTION OF THE DRAWINGS

The drawings illustrate one embodiment of the present invention, wherein.

DESCRIPTION OF THE PREFERRED EMBODIMENTS

The present invention will not be described by way of one embodiment with reference to the accompanying drawings.

Figure 1:
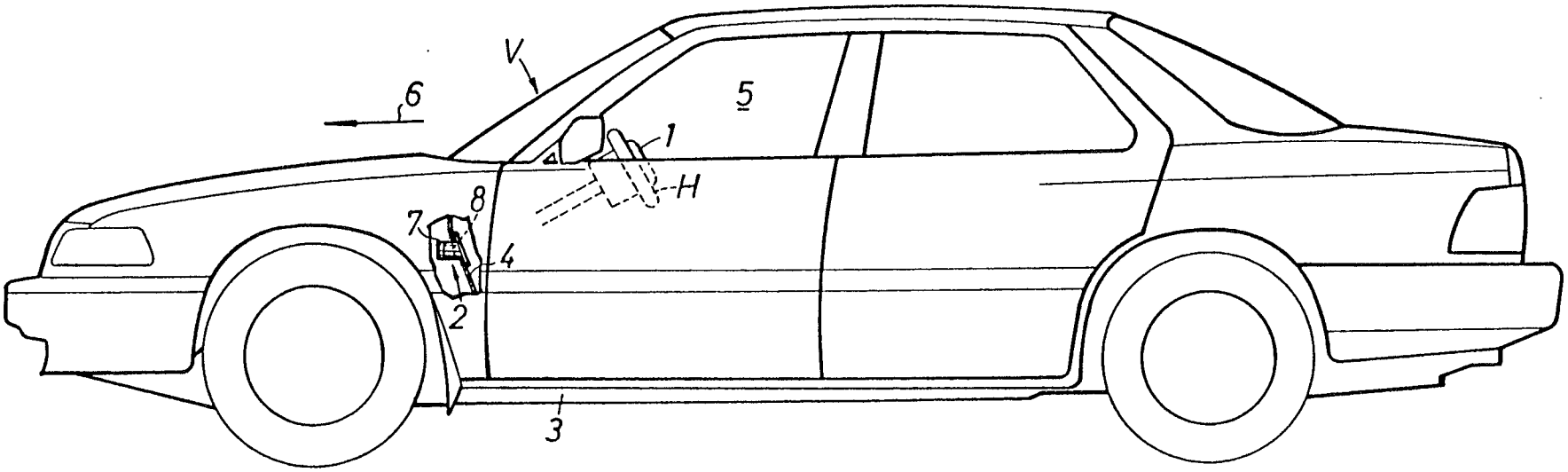
FIG. 1 is a partially cutaway side view illustrating a vehicle and an acceleration detecting system carried on the vehicle.
Figure 2:
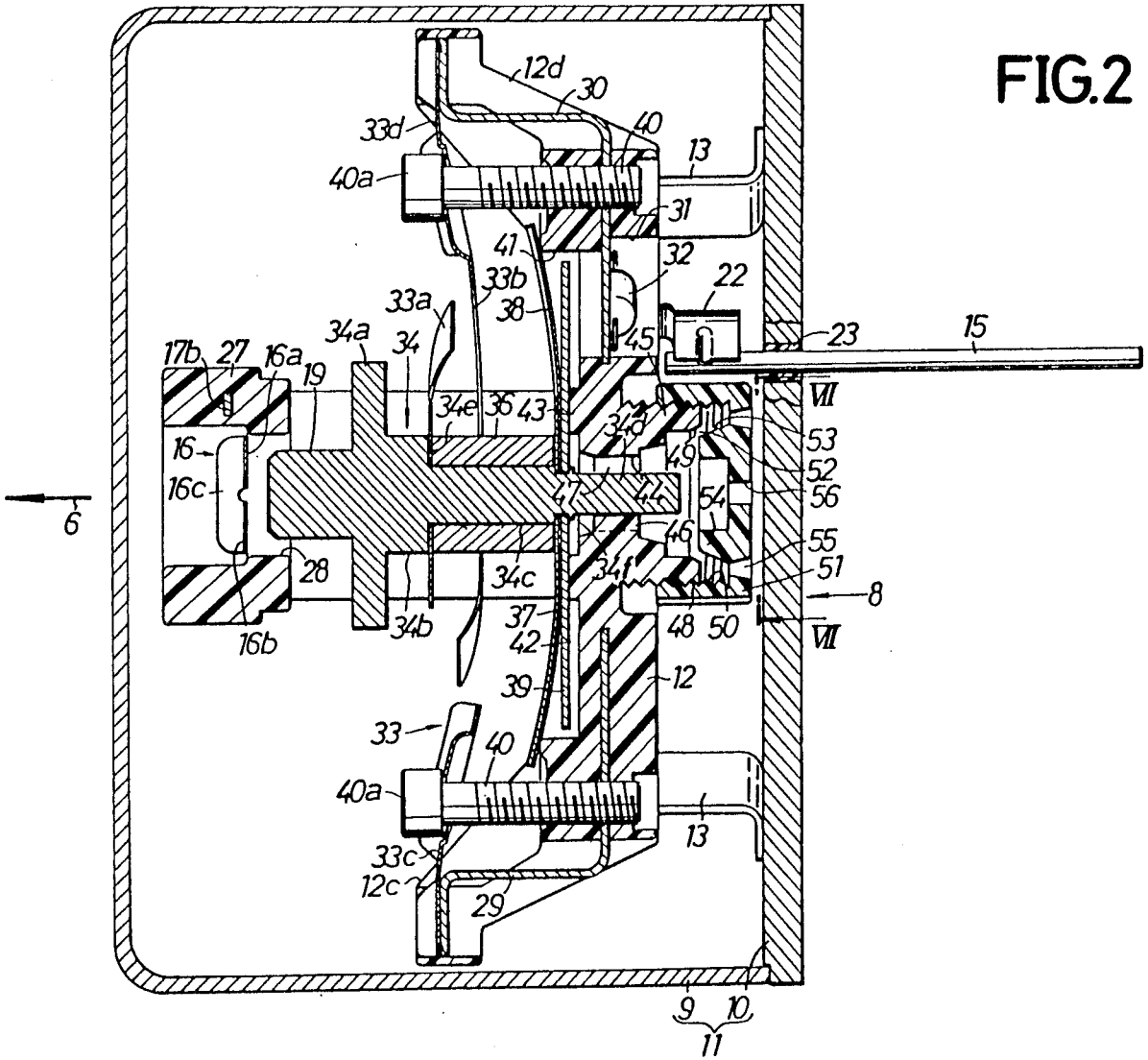
FIG. 2 is a longitudinal sectional side view of essential portions of the acceleration detecting system.
Figure 3:
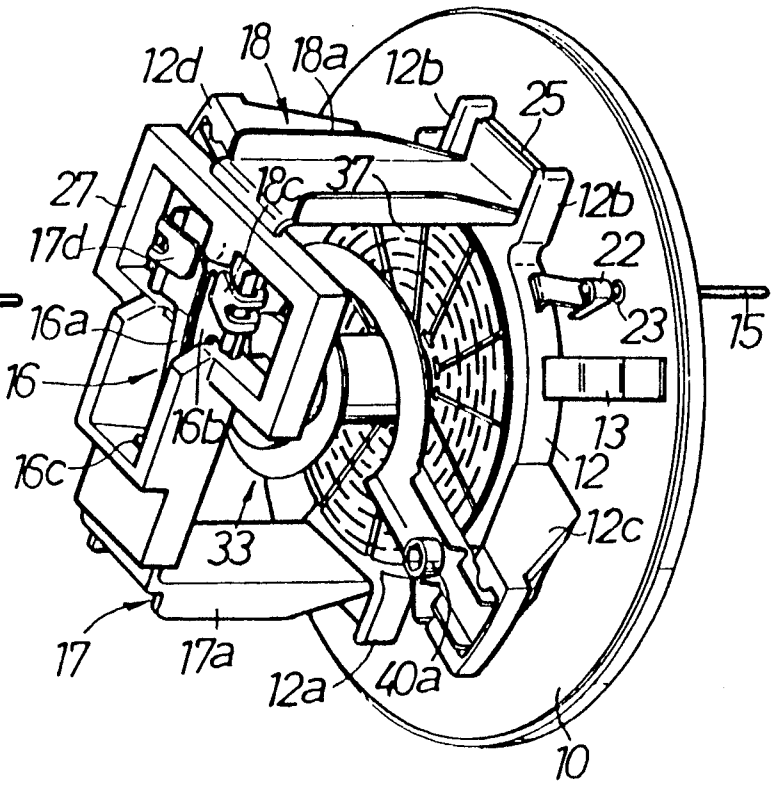
FIG. 3 is a perspective view similar to FIG. 2, except for elimination of a closed housing.
Figure 5:
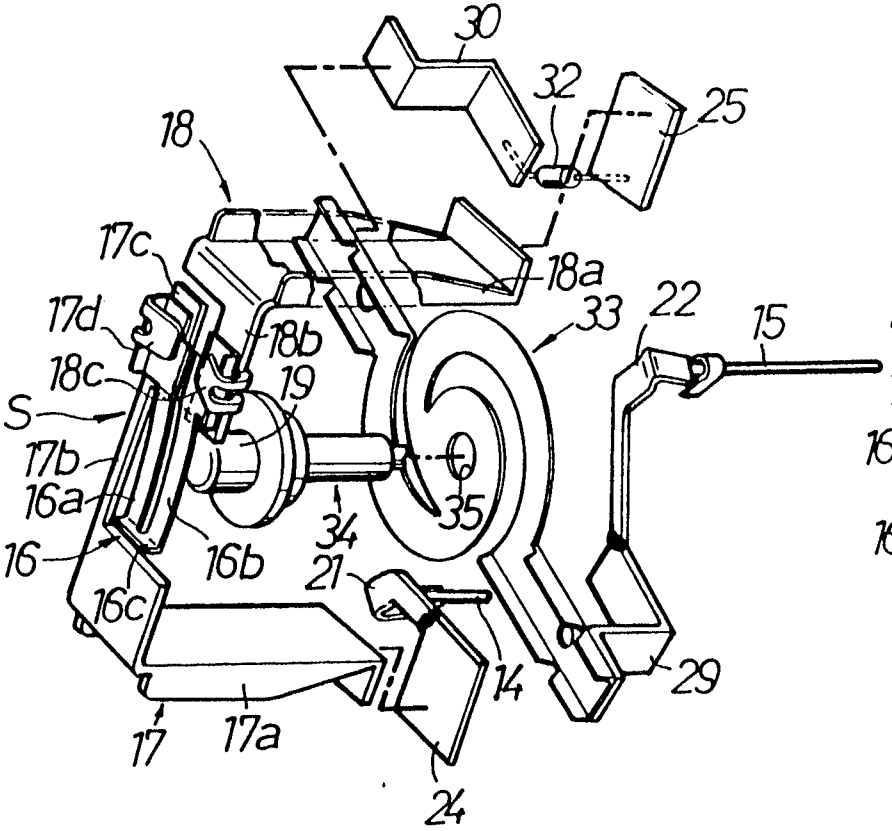
FIG. 5 is an exploded perspective view of only portions required to illustrate an electrically connected condition.
Figure 4:
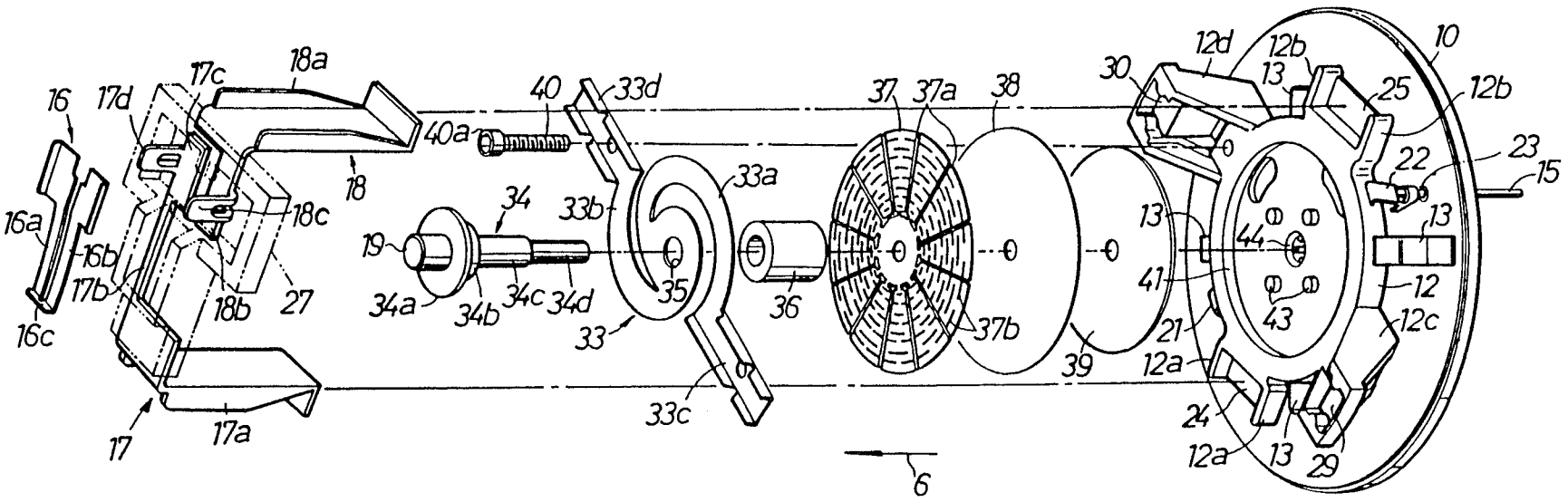
FIG. 4 is an exploded view of the portions shown in FIG. 3.

Referring first to FIG. 1, an air bag arrangement 1 is disposed on a steering handle H in a vehicle V, and an acceleration detecting system 2 is mounted on a dashboard 4 on a vehicle body 3 as a moving object for actuating the air bag arrangement 1. More specifically, the dash board 4 is mounted on the vehicle body 3 to be exposed at a front portion of a compartment 5 in the vehicle V, and a casing 7 for the acceleration detecting system 2 is attached to a lower portion of the dashboard 4 to extend in a direction 6 of forward movement of the vehicle V.

Referring also to FIGS. 2, 3, 4 and 5, the acceleration detecting system 2 comprises a detecting unit 8 fixedly housed and disposed in the casing 7. The detecting unit 8 includes a closed housing 11 which comprises a bottomed cylindrical cap 9 having an axis aligned with the forward moving direction 6 and having an opening end closed by a disk-like end plate 10. The closed housing 11 is fixedly disposed within the casing 7 with the closed end of the cap 9 being directed forwardly in the forward moving direction 6.

A base plate 12 made of a non-conductive material such as synthetic resin is disposed within the closed housing 11, with a plurality of e.g., four leg members 13—interposed between the base plate 12 and an inner surface of the end plate 10. A first connecting terminal 14 and a second pin-like connecting terminal 15 each have an axis aligned with the forward moving direction 6 and are also disposed in the closed housing 11 and the terminals extend through the end plate 10 with sealing members 23 of a non-conductive material interposed therebetween. A stationary contact 16, electrically connected to the first connecting terminal 14, is fixedly disposed on the base plate 12 through a first connecting plate 17 and a second connecting plate 18 made of a conductive metal. A movable contact 19, cooperating with the stationary contact 16 to constitute an acceleration detecting switch S, is floatingly supported on the base plate 12 in an opposed relation to the stationary contact 16 in the rear of the latter in the forward moving direction 6. The movable contact 19 is electrically connected to the second connecting terminal 15.

The base plate 12 is basically formed into a disk shape. The leg portions 13 are coupled at one end thereof to an outer periphery of the base plate 12 at four circumferentially equally spaced-apart points and at another end thereof to the end plate 10. This ensures that the base plate 12 is fixedly supported on the end plate 10 at a location spaced apart forwardly from the end plate 10 in the forward moving direction 6. Moreover, a first connecting member 21 and a second connecting member 22 made of a conductive metal are embedded in the base plate 12, with a portion of each member 21, 22 projecting from the outer periphery on one diametric line of the base plate 12, and the first and second connecting terminals 14 and 15 are coupled to the connecting members 21 and 22 respectively. More specifically, front ends of the pin-like connecting terminals 14 and 15 in the forward moving direction 6 are coupled to the connecting members 21 and 22, respectively.

The base plate 12 has two pairs of supporting projections 12*a*, 12*a* and 12*b*, 12*b* provided thereon in parallel with one diametric line thereof to protrude from the outer periphery thereof at locations offset circumferentially from the connecting members 21 and 22. The base plate 12 also has a first supporting plate 24 and a second supporting plate 25 of a conductive metal embedded therein with a portion of each plate projecting from the outer periphery thereof. Opposite sides of those portions of the first and second supporting plates 24 and 25 which project from the base plate 12 are supported on the supporting projections 12*a*, 12*a*, 12*b* and 12*b*. Further, the first and second connecting plates 17 and 18 are coupled to those portions of the supporting plates 24 and 25 which project from the base plate 12, respectively. Moreover, the first supporting plate 24 and the first connecting member 21 are coupled to each other, so that the first connecting terminal 14, the first connecting member 21, the first supporting plate 24 and the first connecting plate 17 are in electrical conduction.

The first connecting plate 17 comprises a leg 17*a* coupled at one end to the first supporting plate 24 to extend forwardly in the forward moving direction 6 and having the other front end bent at a right angle toward the second connecting plate 18, a connection 17*b* extending from one widthwise side one end at the front end of the leg 17*a* toward the second connecting plate 18, and a coupling plate portion 17*c* provided at a leading (or tip) end of the connection 17*b*. Moreover, the connection 17*b* extending toward the second connecting plate 18 has a width smaller than that of the leg 17*a*, and the coupling plate portion 17*c* is formed to project inwardly perpendicularly from the leading end of the connection 17*b*. Further, at its outer edge, the coupling plate portion 17*c* is provided with a coupling piece 17*d* which projects forwardly in the forward moving direction 6 and which is foldable to couple the stationary contact 16 to the coupling plate portion 17*c*.

The second connecting plate 18 comprises a leg 18*a* coupled at one end to the second supporting plate 25 to extend forwardly in the forward moving direction 6 and having the other, front end bent at a right angle toward the first connecting plate 17, and a coupling plate portion 18*b* provided to extend from the front end of the leg 18*a* on a side thereof widthwise opposite from the coupling plate portion 17*c* toward the first connecting plate 17. The coupling plate portions 17*c* and 18*b* are disposed in parallel at a location near the second connecting plate 18. Moreover, the coupling plate portion 18*b* is provided at its outer edge with a coupling piece 18*c* which projects forwardly in the forward moving direction 6 and which is foldable to couple the stationary contact 16 to the coupling plate portion 18*b*.

It should be noted that the stationary contact 16 is substantially U-shaped formed of a pair of parallel plate-like contact portions 16*a* and 16*b* which are coupled at base ends respectively to the coupling plate portions 17*c* and 18*b* of the first and second connecting plate 17 and 18, and which are connected to each other through a connection 16*c*. More specifically, the base ends of the plate-like contact portions 16*a* and 16*b* are coupled to the coupling plate portions 17*c* and 18*b*, respectively, by folding the coupling pieces 17*d* and 18*c* while placing the base ends in abutment against the coupling plate portions 17*c* and 18*b*. The connection 16*c* is connected to the plate-like contact portions 16*a* and 16*b* into an L-shape to have a plane perpendicular to a plane including the contact portions 16*a* and 16*b*. This provides an improvement in rigidity of connecting sections of the plate-like contact portions 16*a* and 16*b* of the stationary contact 16.

The front end of the leg 17*a* as viewed in the forward moving direction 6 and the connection 17*b* in the first connecting plate 17 are connected with the front end of the leg 18*a* of the second connecting plate 18 as viewed in the forward moving direction 6 by a connecting frame 27 of a synthetic resin surrounding the stationary contact 16. That is, when the first and second connecting plates 17 and 18 are coupled with the stationary contact 16, the connecting frame 27 is formed in a manner that the front end of the leg 17*a*, the connection 17*b* and the front end of the leg 18*a* are embedded therein.

At a location corresponding to intermediate portions of the plate-like contact portions 16*a* and 16*b* of the stationary contact 16, the connecting frame 27 is provided with a guide hole 28 extending in the forward moving direction 6. The movable contact 19 is disposed in the guide hole 28 and abuts against the intermediate portion, of the plate-like contact portions 16*a* and 16*b*.

A portion of each of first and second supporting legs 29 and 30 made of a conductive metal is embedded in the base plate 12. The supporting legs 29 and 30 project from the outer periphery of the base plate 12 on one diametric line of the base plate 12 at locations offset circumferentially from the first and second supporting plates 24 and 25 and extend a distance shorter than the first and second connecting plates 17 and 18 forwardly in the forward moving direction 6. Moreover, the base plate 12 is integrally provided with supporting frame portions 12*c* and 12*d* which extend forwardly in the forward moving direction 6 from the outer periphery of the base plate 12 to support front ends of the supporting legs 29 and 30.

That surface of the base plate 12 which is closer to the end plate 10 is provided with a recess 31 which permits a portion of the embedded portion of each of the second supporting leg 30 and the second supporting plate 25 in the base plate 12 to be partly exposed toward the end plate 10. A resistor element 32 is disposed in this recess 31 and coupled at its opposite ends to the second supporting leg 30 and the second supporting plate 25. Thus, the second connecting plate 18 is electrically connected with the second supporting leg 30 through the second supporting plate 25 and the resistor element 32.

A spring member 33 is coupled to the front ends of the supporting legs 29 and 30 in the forward moving direction 6 for floatingly supporting the movable contact 19. The spring member 33 is made of an electric conductive metal and is comprised of a pair of spiral portions 33*a* and 33*b* which are interconnected at a central portion, and a pair of supporting arms 33*c* and 33*d* connected to outer ends of the spiral portions 33*a* and 33*b*. The supporting arms 33*c* and 33*d* extend from the outer ends of the spiral portions 33*a* and 33*b* along one diametric line passing through the central portion of the spiral portions 33*a* and 33*b*. Outer ends of the supporting arms 33*c* and 33*d* are coupled to the front ends of the supporting legs 29 and 30, respectively.

The movable contact 19 is mounted at a front end, as viewed in the forward moving direction 6, of an inertia mass 34 floatingly carried on the base plate 12 through the spring member 33. More specifically, the inertia mass 34 is basically columnarly-shaped and comprised of, in sequence from a front end to a rear end in the forward moving direction 6, the shaft-shaped movable contact 19, a restraining collar 34*a* projecting radially outwardly from a rear end of the movable contact 19, a first shaft portion 34*b* connected to the restraining collar 34*a* with a diameter slightly larger than that of the movable contact 19, a second shaft portion 34*c* connected to the first shaft portion 34*b* with a diameter smaller than that of the first shaft portion 34*b*, and a third shaft portion 34*d* connected to the second shaft portion 34*c* with a diameter smaller than that of the second shaft portion 34*c*, these shaft portions being coaxially connected to one another. The second shaft portion 34*c* is inserted through a through hole 35 provided at a central portion of the spring member 33, and the central portion of the spring member 33 is clamped between a step 34*e* provided between the first and second shaft portions 34*b* and 34*c* and one end of a cylindrical collar 36 fitted over an outer periphery of the second shaft portion 34*c*.

Clamped between the other end of the collar 36 and a collar portion 34*f* provided on the third shaft portion 34*d* are a diaphragm 37 formed into a disk shape, a sealing plate 38 formed into a thin circular plate configuration from a flexible synthetic resin, and a circular supporting plate 39 made of a material having rigidity. More specifically, the diaphragm 37, the sealing plate 38 and the supporting late 39 are inserted through the third shaft portion 34*d* and are then clamped between the other end of the collar 36 and the collar portion 34*f* by formation of the collar portion 34*f* on the third shaft portion 34*d*. This results in the collar 36 being fixed to the inertia mass 34 and the central portion of the spring member 33 being fixed to the inertia mass 34.

Thus, the inertia mass 34 and the movable contact 19 are floatingly supported through the spring member 33 on the first and second supporting legs 29 and 30 fixed to the base plate 12, and in order to permit an adjustment of the spring force of the spring member 33, thread members 40 which are threadedly engaged with the embedded portions of the first and second supporting legs 29 and 30 in the base plate 12 are inserted through intermediate portions of the supporting arms 33*c* and 33*d* of the spring member 33, respectively, while abutting heads 40*a* thereof against the arms 33*c*, 33*d*. Thus, the spring force of the spring member 33 can be adjusted by adjusting the position of each of the thread members 40 in advancing and retreating directions.

Figure 6:
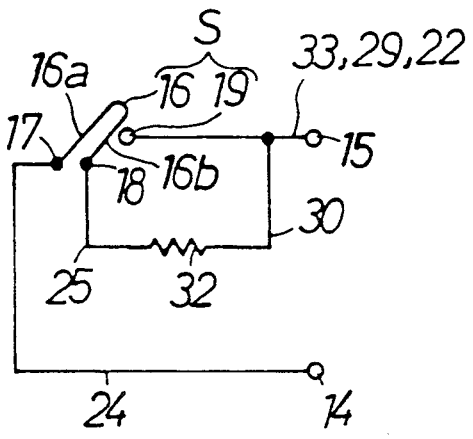
FIG. 6 is a circuit diagram schematically illustrating the condition shown in FIG. 5.
Figure 7:
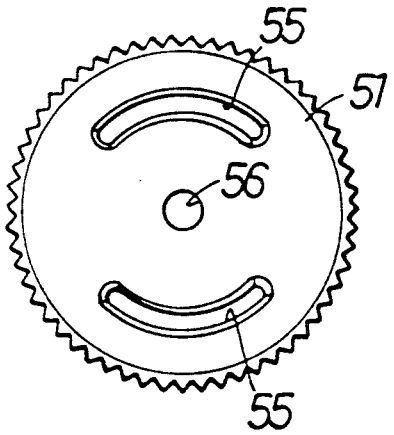
FIG. 7 is a view taken along a line VII—VII in FIG. 2.

It should be noted that as a result of fixing of the spring member 33 of a conductive material to the inertia mass 34, the movable contact 19 is in electric conduction with the second connecting terminal 15 through the first supporting leg 29 and the second connecting member 22. The second connecting plate 18 which is in electric conduction with the second supporting leg 30 through the second supporting plate 25 and the resistor element 32, is also in electric conduction with the second connecting terminal 15. A schematic illustration of an energizing circuit in such acceleration detecting system 2 is as shown in FIG. 6. More specifically, the acceleration detecting switch S is interposed between the first and second connecting terminals 14 and 15. The first connecting plate 17 coupled to the plate-like contact portion 16*a* of the stationary contact 16 of the acceleration detecting switch S is connected to the first connecting terminal 14, while the second connecting plate 18 coupled to the other plate-like contact portion 16*b* is connected to the second connecting terminal 15 through the resistor element 32.

A circular recess 41 is provided coaxially with the inertia mass 34 on that surface of the base plate 12 which is remote from the end plate 10. The diameter of the circular recess 41 is set smaller than those of the diaphragm 37 and the sealing plate 38 and larger than that of the supporting plate 39. The diaphragm 37 abuts against an opened end edge of the circular recess 41 through the sealing plate 38, and the supporting plate 39 is contained within the circular recess 41. The diaphragm 37 comprises a thin circular metal plate provided with a plurality of radially extending notches 37*a* as well as a large number of arcuate notches 37*b*. And the sealing plate 38 is brought into close contact with that surface of the diaphragm 37 which faces the circular recess 41. This ensures the inhibition of gas flow through the notches 37*a* and 37*b* and defines a damper chamber 42 between the sealing plate 38 and a closed end of the circular recess 41.

A plurality of projections 43 are provided at the closed end of the circular recess 41 around the inertia mass 34, and the supporting plate 39 is abuttable against these projections 43. In a normal condition where no acceleration acts on the inertia mass 34, the spring member 33 exhibits a spring force for biasing the inertia mass 34 to a position at which the supporting plate 39 abuts against the projections 43. In such a condition, the diaphragm 37 and the sealing plate 38 have their central portions deflected toward the damper chamber 42.

The base plate 12 is bored with a hole 44 which is opened to the center of the closed end of the circular recess 41, i.e., the center of the damper chamber 42, and a cylindrical portion 45 is projectingly provided on that of the plate 12 surface closer to the end plate 10 to coaxially surround the hole 44. A plurality of guide projections 46 are provided at circumferential distances on the inner surface of an intermediate portion of the hole 44 for guiding the third shaft portion 34*d* of the inertia mass 34, and passages 47 are defined by adjacent guide projections 46, the third shaft portion 34*d* and the inner surface of the hole 44. The cylindrical portion 45 has external threads 48 formed on its outer surface, and a tapered surface 49 provided at an axially outer end thereof connected to an outer end of the hole 44.

A bottomed cylindrical adjusting member 51 is provided and has, on its inner surface, internal threads 50 threadedly engageable with the external threads 48. Thus, the member 51 is threadedly engaged with the cylindrical portion 45 for relative advancing and retreating movement. The adjusting member 51 has a projection 54 coaxially provided on an inner surface of the closed end thereof and having, on its outer peripheral surface, a tapered surface 53 which is opposed to the tapered surface 49 to define an annular variable orifice therebetween. A pair of arcuate introducing holes 55 are also provided in the adjusting member 51 at its closed end at a constant from and around the periphery of the projection 54 to communicate with the damper chamber 52 via the variable orifice 52 and the passages 47. Further, a fixed orifice 56 is coaxially provided in the adjusting member 51 at a central portion of its closed end to lead to the damper chamber 42 via the passages 47.

Thus, the spacing between the tapered surfaces 49 and 53, i.e., the degree of restriction of the variable orifice 52 can be adjusted by changing the position of the adjusting member 51 threadedly engaged with the cylindrical portion 45.

If a deceleration equal to or more than a predetermined value acts on the vehicle body 3 and the base plate 12, the inertia mass 34 and the movable contact 19 are then urged to advance against the spring force of the spring member 33. The force to advance the inertia mass 34 acts on the diaphragm 37 also to move forwardly in the forward moving direction 6, i.e., in a direction to increase the volume of the damper chamber 42. However, the flowing of gas into the damper chamber 42 is restricted by the fixed orifice 56 and the variable orifice 52, and if the inertia mass 34 and the movable contact 19 are urged to advance to such an extent that the volume of the damper chamber 42 increases in excess of the amount of gas flowing into the damper chamber 42 through the variable orifice 52 and the fixed orifice 56, negative pressure is developed in the damper chamber 42, thereby causing a damping force to act in a direction opposite the forward moving direction 6 on the movable contact 19. Consequently, the spring force of the spring member 33 and such damping force act on the inertia mass 34 and on the movable contact 19 in the direction opposite the forward moving direction 6.

In addition, if the axis of the inertia mass 34 in a state inclined relative to the axis of the hole 44 in the base plate 12 and the axis of the guide hole 28 in the connecting frame 27, the third shaft portion **34*d* and the movable contact 19 may be caught in the guide projections 46 and the guide hole 28, and the frictional force between the third shaft portion 34*d* and the guide projections 46 as well as between the movable contact 19 and the guide hole 28 may increase and make the axial movement of the inertia mass 34 and movable contact 19 not smooth. In view of this, according to this embodiment the diameter of the supporting plate 39 is set such that the axis of the inertia mass 34 cannot be inclined or fallen down in the above-described manner in a condition in which the outer edge of the supporting plate 39 comes into abutment against the closed end of the circular recess 41 in the base plate 12**.

The operation of this embodiment will be described below. If a deceleration acts on the vehicle body 3 and thus on the base plate 12, the inertia mass 34 and movable contact 19 are urged to move forwardly in the forward moving direction 6 under the influence of an inertia force acting against the spring force of the spring member 33 and the damping force generated from an increase in the volume of the damper chamber 42. When the deceleration is large enough for the inertia force to overcome the spring force and the damping force, the movable contact 19 is caused to abut against the intermediate portions of the plate-like contact portions **16*a* and 16*b* of the stationary contact 16, thereby turning on the acceleration detecting switch S to trigger the air bag arrangement 1**.

In such an acceleration detecting system 2, when the acceleration detecting switch S is opened, there is formed, between the first connecting terminal 14 and the second connecting terminal 15, an energizing circuit which is comprised of the first connecting member 21, the first supporting plate 24, the first connecting plate 17, the stationary contact 16, the second connecting plate 18, the second supporting plate 25, the resistor element 32, the second supporting leg 30, the spring member 33, the first supporting leg 29 and the second connecting member 22, all of which are connected in series. Thus, any failure of conduction between the first and second connecting terminals 14 and 15 can be detected by monitoring energization of the energizing circuit, for example, periodically. Accordingly, even if the stationary contact 16 of a plate-like configuration is broken at its intermediate portion, it is possible to detect such a breakage.

Moreover, the stationary contact 16 is formed into a substantially U-shape such that a plate-like contact portion **16*a* is coupled at its base end to the first connecting plate 17, which is electrically connected to the first connecting terminal 14 and is connected with the leading end of the plate-like contact portion 16*b* which is coupled at its base end to the second connecting plate 18. The second connecting plate 18 is electrically connected to the second connecting terminal 15. Therefore, if a failure of conduction at the coupled point of the stationary contact 16 to the first and second connecting plates 17 and 18** occurs, the energizing circuit fails in conduction. This makes it possible to reliably detect the state of conduction at a point which is liable to fall in conduction.

Moreover, since the movable contact 19 is arranged to abut against the intermediate portions of the plate-like contact portions **16*a* and 16*b* in the stationary contact 16, even if the stationary contact 16 is broken at the connection 16*c* connecting the plate-like contact portions 16*a* and 16*b*, the closed state of the acceleration detecting switch S can be achieved. In this case, of course, if a construction is such that at least the plate-like contact portion 16*a* closer to the first connecting terminal 14 can be abutted by the movable contact 19**, the closed state of the acceleration detecting switch S can thereby be achieved.

In addition, the variable orifice 52 and the fixed orifice 56 for restricting the amount of gas flowing into the damper chamber 42 for applying the damping force to the inertia mass 34 and thus to the movable contact 19 are symmetric in shape with respect to the axis of the inertia mass 34 and communicate with the damper chamber 42 through the passages 47. Therefore, the gas flow into the damper chamber 42 can be symmetric with respect to the axis of the inertia mass 34, and it is possible to provide a substantially uniform gas pressure distribution within the damper chamber 42 over the entire surface thereof, thereby realizing a stable motion of the inertia mass 34 and thus of the movable contact 19.

Moreover, the degree of restriction provided by the variable orifice 52 for controlling the damping force applied to the inertia mass 34 and the movable contact 19 can be adjusted by changing the threaded position of the adjusting member 51 relative to the cylindrical portion 45 coaxially provided on the base plate 12. This enables the damping force to be adjusted with a simple structure eliminating the need for a complicated passage defined in the base plate 12, since a passage may be required in a structure in which an adjusting member is provided on a side of the base plate 12.

What is claimed is:

1. An acceleration detection system comprising:

a base plate made of non-conductive material and mounted on a moving object;

a stationary contact fixedly disposed on the base plate and electrically connected to a first connecting terminal, said stationary contact having an intermediate portion; and a movable contact cooperating with the stationary contact to constitute an accelerating detecting switch, said movable contact being floatingly supported on the base plate in an opposed relation to the stationary contact to be movable in a predetermined direction and electrically connected to a second connecting terminal, said stationary contact being electrically connected to the second connecting terminal through a resistor element, wherein said stationary contact is comprised of a first plate-like contact portion fixed and electrically connected at a base end thereof to said first connecting terminal, and a second plate-like contact portion fixed and electrically connected at a base end thereof to said second connecting terminal through said resistor element, free ends of said first and second plate-like contact portions being interconnected and said first and second plate-like contact portions extend substantially perpendicular to a direction of movement of the movable contact, and said movable contact is movable to abut against one of said intermediate portion and said free ends of said stationary contact.

2. An acceleration detecting system according to claim 1, wherein said stationary contact is formed into a substantially U-shape with both the plate-like contact portions being arranged side by side in parallel with each other.

3. An acceleration detecting system according to claim 2, wherein said movable contact is disposed to abut against at least the first plate-like contact portion which is connected to the first connecting terminal.

4. An acceleration detecting system according to claim 1, wherein said movable contact abuts against intermediate portions of the first and second plate-like contact portions.

5. An acceleration detecting system according to claim 1, wherein said first and second plate-like contact portions are disposed side by side on a plane substantially perpendicular to the direction of movement of the movable contact.

* * * * *